US010609962B2

(12) United States Patent
Zhu

(10) Patent No.: US 10,609,962 B2
(45) Date of Patent: Apr. 7, 2020

(54) MOUTH TO LUNG CONVERTIBLE ELECTRONIC CIGARETTES AND METHODS OF USING THE SAME

(71) Applicant: Xiaochun Zhu, Shenzhen (CN)

(72) Inventor: Xiaochun Zhu, Shenzhen (CN)

(73) Assignee: SHENZHEN KANGER TECHNOLOGY CO., LTD., Shenzhen (CN)

( * ) Notice: Subject to any disclaimer, the term of this patent is extended or adjusted under 35 U.S.C. 154(b) by 246 days.

(21) Appl. No.: 15/839,819

(22) Filed: Dec. 12, 2017

(65) Prior Publication Data

US 2019/0174826 A1 Jun. 13, 2019

(30) Foreign Application Priority Data

Dec. 11, 2017 (CN) ..... 2017 1 1305568

(51) Int. Cl.
*A24F 47/00* (2020.01)
*H05B 3/80* (2006.01)
*H05B 3/06* (2006.01)

(52) U.S. Cl.
CPC ..... *A24F 47/008* (2013.01); *H05B 3/06* (2013.01); *H05B 3/80* (2013.01)

(58) Field of Classification Search
CPC ..... A24F 47/008
See application file for complete search history.

(56) References Cited

U.S. PATENT DOCUMENTS

| | | | | |
|---|---|---|---|---|
| 10,123,568 | B1 * | 11/2018 | Zhu | A24F 47/008 |
| 2016/0366940 | A1 * | 12/2016 | Liu | A24F 47/008 |
| 2018/0132533 | A1 * | 5/2018 | Chen | A24F 47/008 |
| 2018/0184722 | A1 * | 7/2018 | Murison | F04B 43/046 |
| 2018/0338528 | A1 * | 11/2018 | Zhu | A24F 47/008 |
| 2019/0307170 | A1 * | 10/2019 | Zarifian | G05D 11/132 |
| 2019/0307171 | A1 * | 10/2019 | Kane | A24F 47/008 |
| 2019/0307175 | A1 * | 10/2019 | Rostami | H04B 7/26 |

* cited by examiner

*Primary Examiner* — James Harvey
(74) *Attorney, Agent, or Firm* — Ming Jiang; MM IP Services LLC

(57) ABSTRACT

Aspects of the present disclosure relate to a mouth to lung convertible electronic cigarette. In certain embodiments, mouth to lung convertible electronic cigarette includes: a cartridge top portion, a cartridge bottom portion, and a control circuit. The cartridge top portion includes an E-liquid storage tank and a convertible vaporizer. E-liquid vapor volume generated by convertible vaporizer is selectable by a user and selectable E-liquid volume includes a small E-liquid vapor volume generated by a first set of heating element for mouth smoking and a large E-liquid vapor volume generated by a second set of heating element for lung smoking. In certain embodiments, the first set of heating element includes a first heating element. The second set of heating element may include: a second heating element, the first heating element and the second heating element connected in serial, and the first heating element and the second heating element connected in parallel.

20 Claims, 11 Drawing Sheets

MOUTH TO LUNG CONVERTIBLE ELECTRONIC CIGARETTES AND METHODS OF USING THE SAME

FIELD

The present disclosure generally relates to the field of electronic cigarettes, and more particularly to mouth to lung convertible electronic cigarettes, and methods of using the mouth to lung convertible electronic cigarettes.

BACKGROUND

It is well known that smoking cigarette is harmful to smoker's health. The active ingredient in a cigarette is mainly nicotine. During smoking, nicotine, along with tar aerosol droplets produced in the cigarette burning, are breathed into the alveolus and absorbed quickly by the smoker. Once nicotine is absorbed into the blood of the smoker, nicotine then produces its effect on the receptors of the smoker's central nervous system, causing the smoker relax and enjoy an inebriety similar to that produced by an exhilarant.

The electronic cigarette is sometimes referred as electronic vaporing device, personal vaporizer (PV), or electronic nicotine delivery system (ENDS). It is a battery-powered device which simulates tobacco smoking. It generally uses a heating element that vaporizes a liquid solution (e-liquid). Some solutions contain a mixture of nicotine and a variety of flavorings, while others release a flavored vapor without nicotine. Many are designed to simulate smoking experience, such as cigarette smoking or cigar smoking. Some of them are made with similar appearance, while others are made considerably different in appearance.

Different smokers have different smoking habits. Some smokers want to have a limited amount of E-liquid vapor, and these smokers are sometime referred as mouth smokers. Others want to have large amount of E-liquid vapor, and these smokers are sometime referred as lung smokers. It is desirable to have an electronic cigarette that satisfies the needs of both types of smokers.

Therefore, an unaddressed need exists in the art to address the aforementioned deficiencies and inadequacies.

SUMMARY

In one aspect, the present disclosure relates to a mouth to lung convertible electronic cigarette. In certain embodiments, the mouth to lung convertible electronic cigarette includes: a cartridge top portion, a cartridge bottom portion, and a control circuit. The cartridge top portion includes an E-liquid storage tank and a convertible vaporizer. E-liquid vapor volume generated by the convertible vaporizer is selectable by a user and the selectable E-liquid volume includes a small E-liquid vapor volume generated by a first set of heating element for mouth smoking and a large E-liquid vapor volume generated by a second set of heating element for lung smoking. In certain embodiments, the first set of heating element includes a first heating element. The second set of heating element may include: a second heating element, the first heating element and the second heating element connected in serial, and the first heating element and the second heating element connected in parallel.

In certain embodiments, the cartridge bottom portion includes a vapor control sliding switch for selecting the E-liquid vapor volume and an electrical power source for providing electrical power to the mouth to lung convertible electronic cigarette. The control circuit is positioned inside of the cartridge bottom portion for detecting low E-liquid level condition, displaying a low E-liquid level warning when the E-liquid level in the E-liquid storage tank is at a first predetermined level and disconnecting the electrical power source to the mouth to lung convertible electronic cigarette when the E-liquid in the E-liquid storage tank is at a second predetermined level.

In certain embodiments, the convertible vaporizer is positioned around an E-liquid vapor path. The convertible vaporizer includes: a heating element base, a first E-liquid storage medium ring, and a second E-liquid storage medium ring. The heating element base is used to mount the first heating element around a first E-liquid storage medium bar and the second heating element around a second E-liquid storage medium bar. The first E-liquid storage medium ring is in direct contact with the heating element base to allow the E-liquid in the first E-liquid storage medium ring to flow to the first E-liquid storage medium bar and the second E-liquid storage medium bar. The second E-liquid storage medium ring is in direct contact with the first E-liquid storage medium ring to allow the E-liquid in the E-liquid storage tank to flow through the first E-liquid storage medium ring to the first E-liquid storage medium bar and the second E-liquid storage medium bar.

In certain embodiments, the convertible vaporizer is positioned around the E-liquid vapor path. The convertible vaporizer includes: a heating element e-liquid storage medium, the first E-liquid storage medium ring, and the second E-liquid storage medium ring. A combined heating element is mounted around the heating element e-liquid storage medium. The combined heating element includes a first heating element portion for generating the small E-liquid vapor volume and a second heating element portion for generating the large E-liquid vapor volume. The first heating element portion includes the first heating element. The second heating element portion may include the second heating element, the first heating element and the second heating element connected in serial, and the first heating element and the second heating element connected in parallel.

In certain embodiments, the vapor control sliding switch includes a switch slider. In one embodiment, the switch slider includes a first position for mouth smoking and a second position for lung smoking. When the switch slider is placed at the first position, the vapor control sliding switch opens a first air intake opening and connects the first positive output terminal of the electrical power source to the first set of heating element. When the switch slider is placed at the second position, the vapor control sliding switch opens a second air intake opening and connects the second positive output terminal of the electrical power source to the second set of heating element. In another embodiment, the vapor control sliding switch further includes a third position. When the switch slider is placed at the third position, the electrical power source is disconnected to the first set of heating element and the second set of heating element.

In another aspect, the present disclosure relates to a method of using a mouth to lung convertible electronic cigarette. In certain embodiments, the method includes: filling, by a user, E-liquid into an E-liquid storage tank, and installing, by the user, an electrical power source into a cartridge bottom portion. The method also includes: placing, by the user, a switch slider of a vapor control sliding switch to one of a first position and a second position. The first position corresponds to a mouth smoking position where a small E-liquid vapor volume is generated by a first set of heating element, and the second position corresponds to a lung smoking position where a large E-liquid vapor volume is generated by a second set of heating element. When the switch slider is placed in the first position, the method includes opening a first air intake opening and providing by the electrical power source electrical power to the first set of heating element to generate the small E-liquid vapor volume by the first set of heating element. When the switch slider is placed in the second position, the method also includes opening a second air intake opening and providing by the electrical power source electrical power to the second set of heating element to generate the large E-liquid vapor volume by the second set of heating element.

In certain embodiments, the vapor control sliding switch may include a third position. When the switch slider of the vapor control sliding switch is placed in the third position, the electrical power source is disconnected from the mouth to lung convertible electronic cigarette. In certain embodiments, the first set of heating element includes a first heating element. The second set of heating element may include: a second heating element, the first heating element and the second heating element connected in serial, and the first heating element and the second heating element connected in parallel.

In certain embodiments, the method further includes: displaying a warning when a control circuit detects that level of the E-liquid filled in the E-liquid storage tank is at a first predetermined level, and disconnecting the electrical power source to the mouth to lung convertible electronic cigarette when the control circuit detects that level of the E-liquid filled in the E-liquid storage tank is at a second predetermined level.

These and other aspects of the present disclosure will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and, together with the written description, serve to explain the principles of the disclosure. Wherever possible, the same reference numbers are used throughout the drawings to refer to the same or like elements of an embodiment. The drawings do not limit the present disclosure to the specific embodiments disclosed and described herein. The drawings are not necessarily to scale, emphasis instead being placed upon clearly illustrating the principles of the disclosure, and wherein.

DETAILED DESCRIPTION

Figure 1:
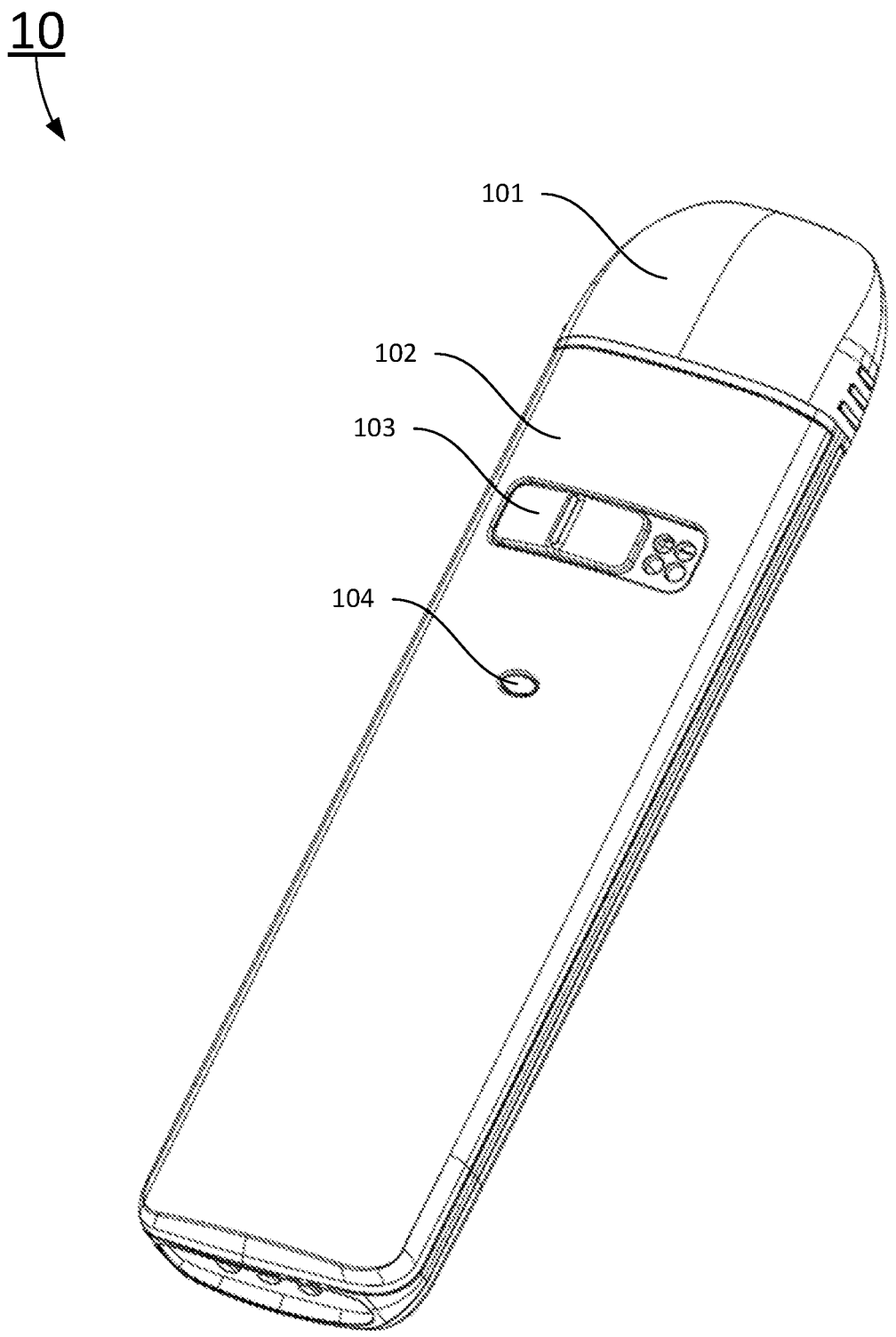
FIG. 1 is a perspective external view of an exemplary mouth to lung convertible electronic cigarette according to certain embodiments of the present disclosure.

The present disclosure will now be described more fully hereinafter with reference to the accompanying drawings, in which exemplary embodiments of the disclosure are shown. This disclosure may, however, be embodied in many different forms and should not be construed as limited to the embodiments set forth herein. Rather, these embodiments are provided so that this disclosure will be thorough and complete, and will fully convey the scope of the disclosure to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present disclosure.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," or "includes" and/or "including" or "has" and/or "having" when used herein, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom", "upper" or "top," and "front" or "back" may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around", "about" or "approximately" shall generally mean within 20 percent, preferably within 10 percent, and more preferably within 5 percent of a given value or range. Numerical quantities given herein are approximates, meaning that the term "around", "about" or "approximately" can be inferred if not expressly stated.

Many specific details are provided in the following descriptions to make the present disclosure be fully understood, but the present disclosure may also be implemented by using other manners different from those described herein, so that the present disclosure is not limited by the specific embodiments disclosed in the following.

The description will be made as to the embodiments of the present disclosure in conjunction with the accompanying drawings FIGS. 1 through 11.

Referring to FIGS. 1 through 9, in one aspect, the present disclosure relates to a mouth to lung convertible electronic cigarette 10. In certain embodiments, the mouth to lung convertible electronic cigarette 10 includes: a cartridge top portion 101, a cartridge bottom portion 102, a vapor control sliding switch 103, and a low E-liquid level warning display 104. The cartridge top portion 101 includes an E-liquid storage tank 10120 for storing E-liquid for the mouth to lung convertible electronic cigarette 10 and a convertible vaporizer 10118 for generating E-liquid vapor for the mouth to lung convertible electronic cigarette 10. The cartridge bottom portion 102 includes a vapor control sliding switch 103 for selecting the E-liquid vapor volume and an electrical power source 1037 for providing electrical power to the mouth to lung convertible electronic cigarette 10.

Figure 2:
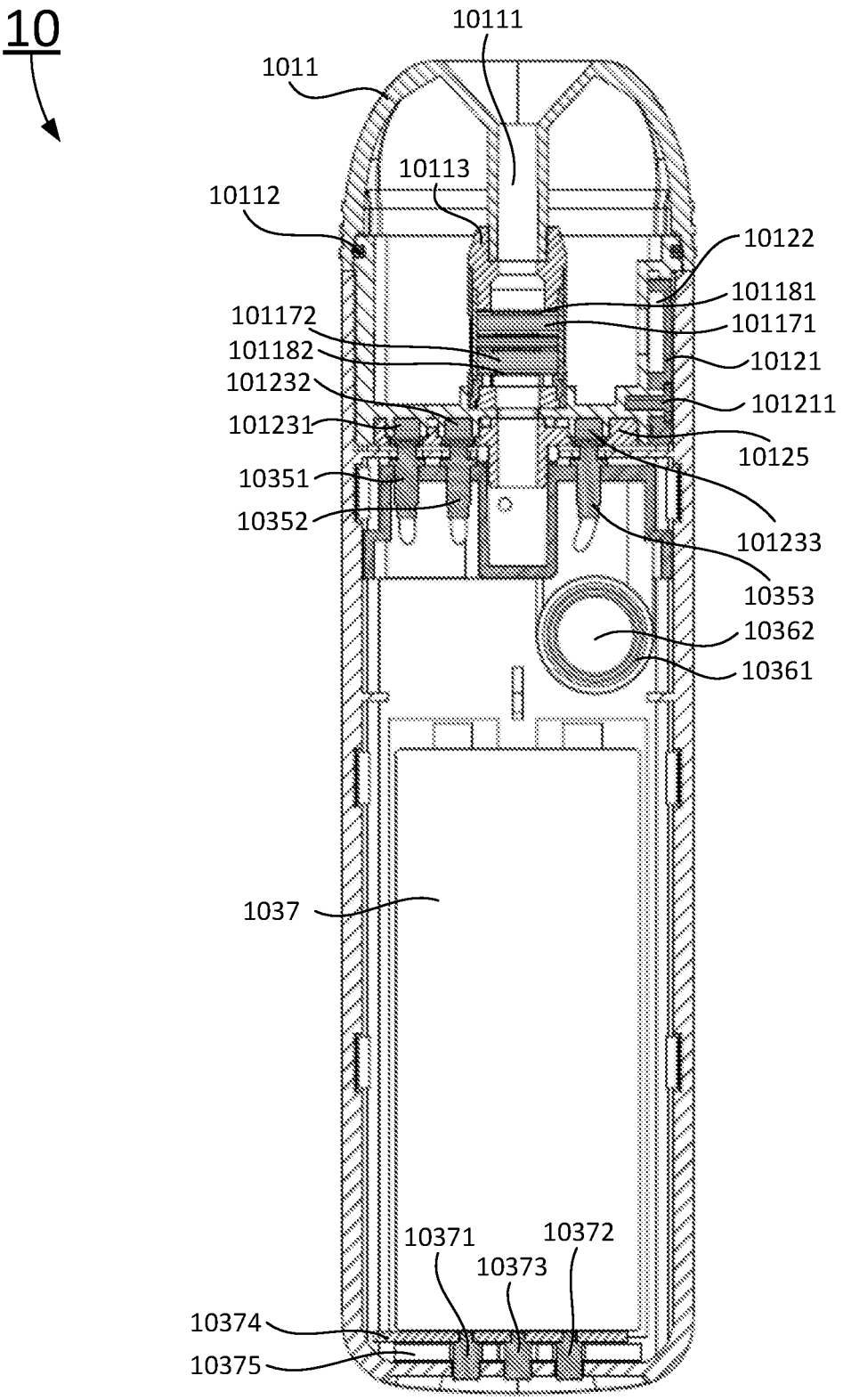
FIG. 2 is a sectional view of the exemplary mouth to lung convertible electronic cigarette according to certain embodiments of the present disclosure.
Figure 7B:
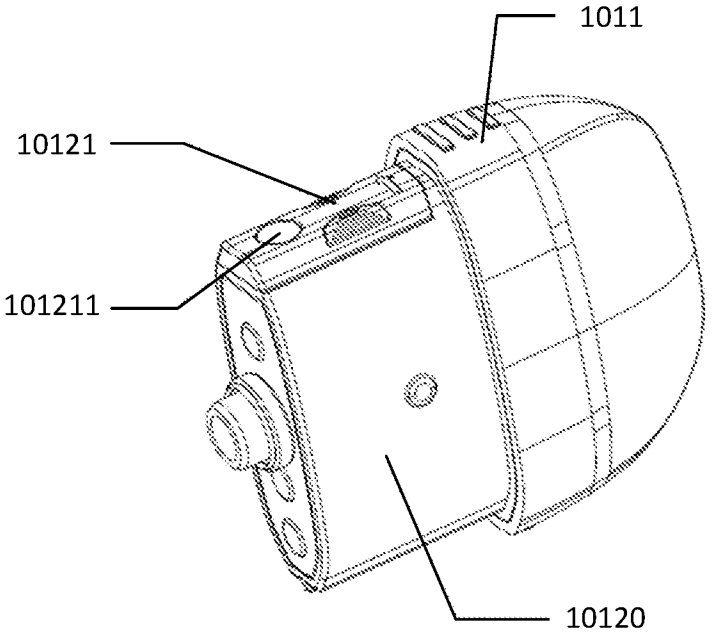
FIG. 7B is a perspective external view of the cartridge top portion when the E-liquid refill cover is closed according to certain embodiments of the present disclosure.
Figure 7A:
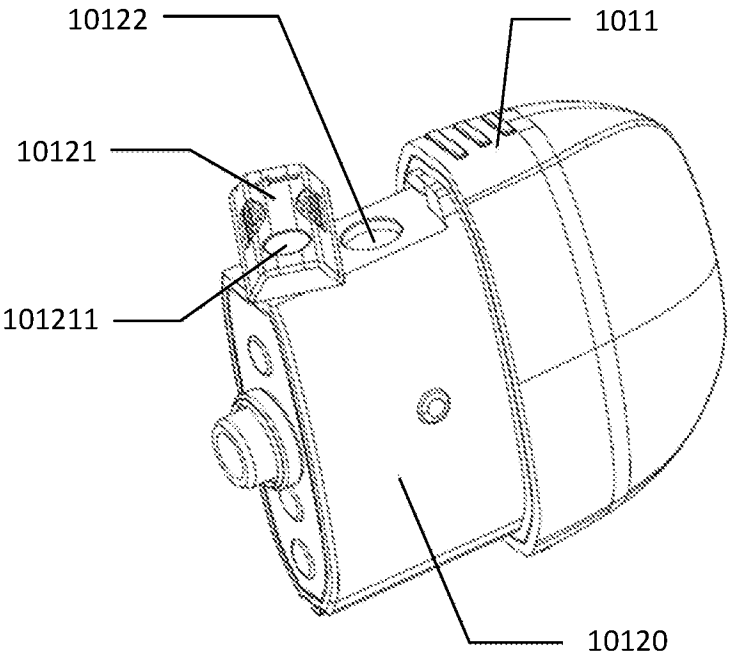
FIG. 7A is a perspective external view of the cartridge top portion when an E-liquid refill cover is open.

In certain embodiments, as shown in FIG. 2, the cartridge top portion 101 includes the E-liquid storage tank 10120 and the convertible vaporizer 10118. In certain embodiments, as shown in FIGS. 7A and 7B, the E-liquid storage tank 10120 includes an E-liquid refill cover 10121 attached on the E-liquid storage tank 10120 through an E-liquid refill cover anchor 101211. The E-liquid refill cover 10121 may be rotated in a first direction to expose an E-liquid refill opening 10122 for refilling E-liquid into the E-liquid storage tank 10120, and rotated in a second, reverse direction to close the E-liquid refill opening 10122 after the refilling. The first direction includes a clockwise direction, and a counter clockwise direction. The second direction includes the counter clockwise direction, and the clockwise direction.

In certain embodiments, the cartridge top portion 101 includes a first sealing ring 10112 for sealing the top end of the E-liquid storage tank 10120, and a second sealing ring 10119 for sealing the bottom end of the E-liquid storage tank 10120.

In certain embodiments, as shown in FIG. 2, the cartridge top portion 101 includes a mouthpiece cover 1011. The mouthpiece cover 1011 defines an E-liquid vapor path 10111 in a center of the cartridge top portion 101 allowing air to pass from a bottom of the cartridge top portion 101, through the convertible vaporizer 10118 to a top of the cartridge top portion 101. The cartridge top portion 101 also includes a first heating element positive terminal 101231 for connecting a first set of heating element to a first positive output terminal 10351 of the electrical power source 1037, a second heating element positive terminal 101232 for connecting a second set of heating element to a second positive output terminal 10352 of the electrical power source 1037, and a heating element negative terminal 101233 for connecting a negative output terminal 10353 of the electrical power source 1037 to the first set of heating element and the second set of heating element.

Figure 3:
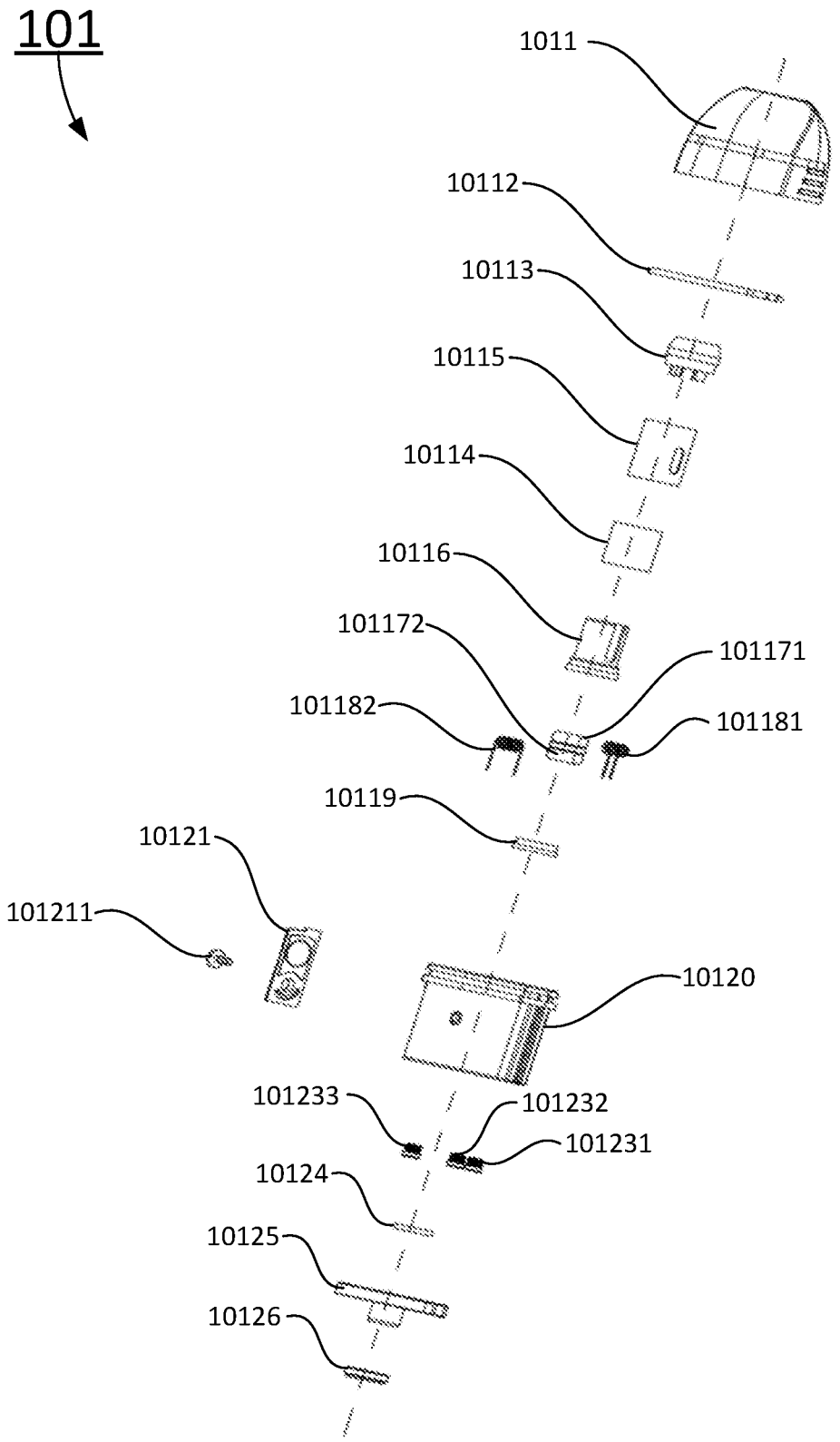
FIG. 3 is an exploded perspective view of a cartridge top portion of the exemplary mouth to lung convertible electronic cigarette according to certain embodiments of the present disclosure.
Figure 5:
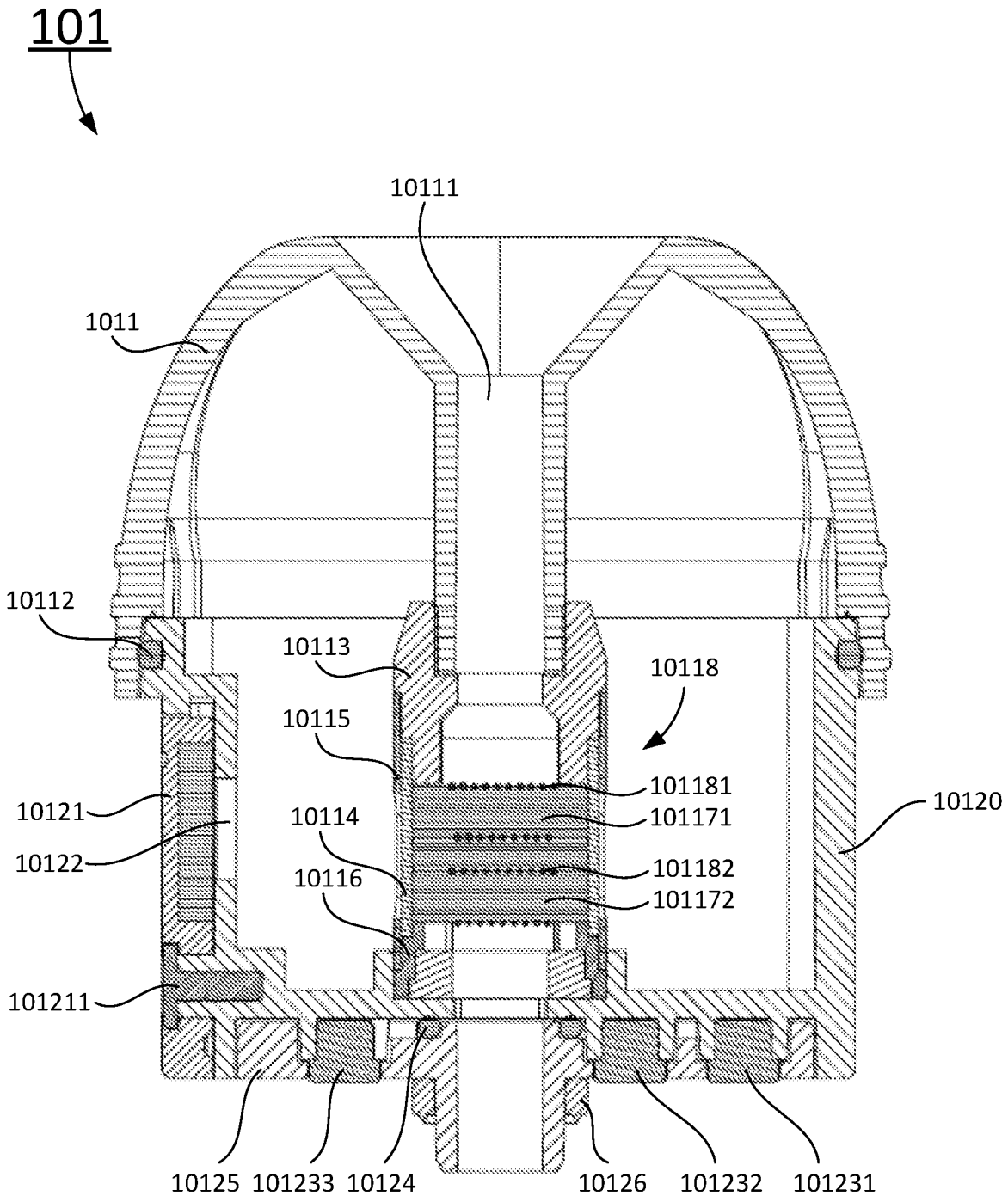
FIG. 5 is a sectional view of the cartridge top portion of the exemplary mouth to lung convertible electronic cigarette according to one embodiment of the present disclosure.

In one embodiment, as shown in FIGS. 2, 3 and 5, the convertible vaporizer 10118 is positioned around the E-liquid vapor path 10111. The convertible vaporizer 10118 includes: a sealing medium 10113 positioned at a top of the convertible vaporizer 10118, a heating element base 10116 positioned at a bottom of the convertible vaporizer 10118, a first E-liquid storage medium ring 10114, and a second E-liquid storage medium ring 10115 coaxially positioned outside of the first E-liquid storage medium ring 10114. The heating element base 10116 is used to mount a first heating element 101181 around a first E-liquid storage medium bar 101171 and a second heating element 101182 around a second E-liquid storage medium bar 101172. The first E-liquid storage medium ring 10114 is in direct contact with the E-liquid in the E-liquid storage tank 10120 and the heating element base 10116 to allow the E-liquid to soak into the first E-liquid storage medium ring 10114 and flow to the first E-liquid storage medium bar 101171 and the second E-liquid storage medium bar 101172. The second E-liquid storage medium ring 10115 is in direct contact with the first E-liquid storage medium ring 10114 to allow the E-liquid in the E-liquid storage tank 10120 to flow through the first E-liquid storage medium ring 10114 and the second E-liquid storage medium ring 10115 to the first E-liquid storage medium bar 101171 and the second E-liquid storage medium bar 101172. The cartridge top portion 101 also includes a first sealing ring 10112 for sealing the top end of the E-liquid storage tank 10120, and a second sealing ring 10119 for sealing the bottom end of the E-liquid storage tank 10120.

Figure 6:
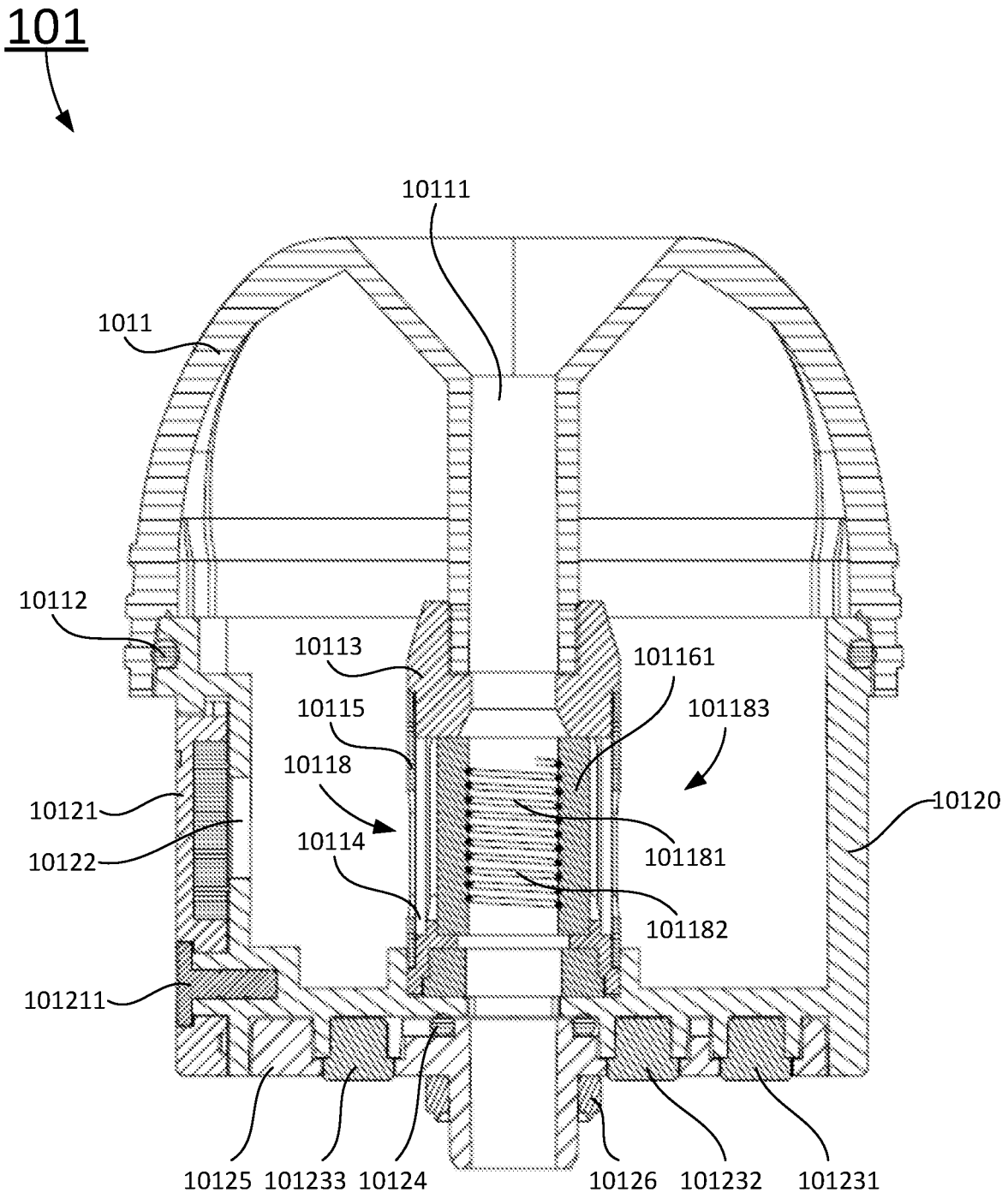
FIG. 6 is a sectional view of the cartridge top portion of the exemplary mouth to lung convertible electronic cigarette according to another embodiment of the present disclosure.

In another embodiment, as shown in FIGS. 2, 3 and 6, the convertible vaporizer 10118 includes: a sealing medium 10113 positioned at a top of the convertible vaporizer 10118, a heating element e-liquid storage medium 101161 coaxially positioned around the E-liquid vapor path 10111, a first E-liquid storage medium ring 10114, and a second E-liquid storage medium ring 10115. A combined heating element is mounted around the heating element e-liquid storage medium 101161. The combined heating element includes a first heating element portion for generating the small E-liquid vapor volume and a second heating element portion for generating the large E-liquid vapor volume. The first heating element portion includes the first heating element 101181. The second heating element portion may include the second heating element 101182, the first heating element 101181 and the second heating element 101182 connected in serial, and the first heating element 101181 and the second heating element 101182 connected in parallel. The cartridge top portion 101 may also include the first sealing ring 10112 for sealing the top end of the E-liquid storage tank 10120, and a third sealing ring 10124 for sealing the bottom end of the E-liquid storage tank 10120.

In certain embodiments, the first E-liquid storage medium ring 10114 is in direct contact with the E-liquid in the E-liquid storage tank 10120 and the heating element e-liquid storage medium 101161 to allow the E-liquid in the E-liquid storage tank 10120 to soak the first E-liquid storage medium ring 10114. The second E-liquid storage medium ring 10115 is in direct contact with the first E-liquid storage medium ring 10114 to allow the E-liquid soaked in the first E-liquid storage medium ring 10114 to flow through the second E-liquid storage medium ring 10115 to the heating element e-liquid storage medium 101161.

The cartridge top portion 101 also includes a bottom cover 10125 and a bottom cover ring 10126 for connecting the cartridge top portion 101 to the cartridge bottom portion 102.

In certain embodiments, the first heating element 101181 and the second heating element 101182 may be made with one or more of: aluminum (Al), Chromium (Cr), Manganese (Mn), Iron (Fe), Cobalt (Co), Nickel (Ni), Copper (Cu), Zirconium (Zr), Niobium (Nb), Molybdenur (Mo), Rhenium (Re), Silver (Ag), Cadmium (Cd), Tantalum (Ta), Tungsten (W), Iridium (Jr), Platinum (Pt), Gold (Au), and alloys of these materials.

Figure 8A:
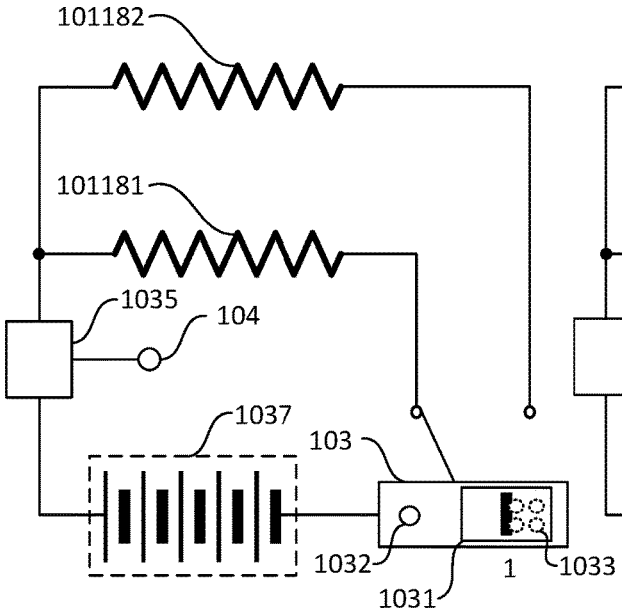
FIG. 8A shows an exemplary control circuit of the exemplary mouth to lung convertible electronic cigarette when a switch slider of a vapor control sliding switch is placed in a first position for mouth smoking.
Figure 8B:
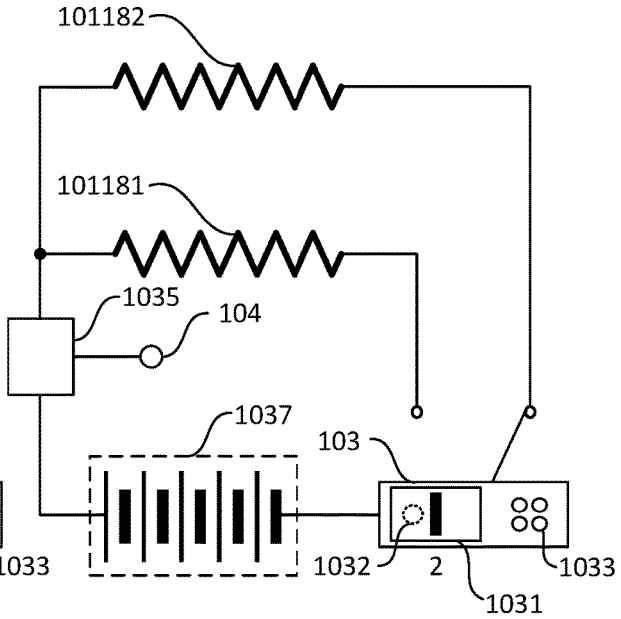
FIG. 8B shows the exemplary control circuit when the switch slider of the vapor control sliding switch is placed in a second position for lung smoking.
Figure 9A:
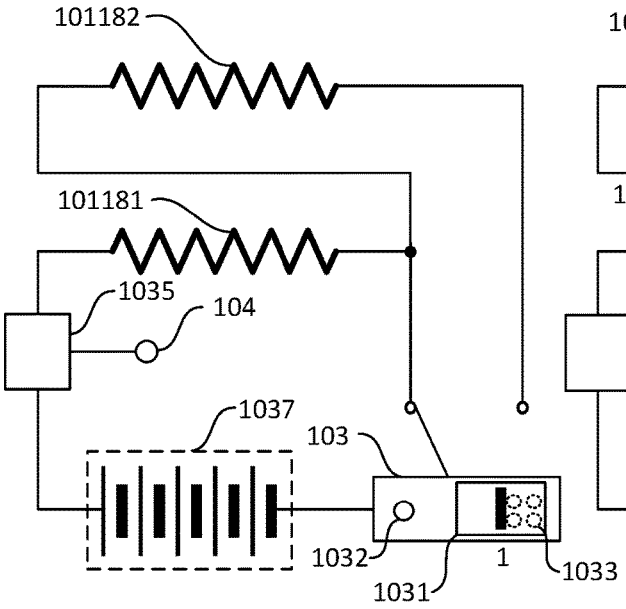
FIG. 9A shows a first heating element is used for mouth smoking when the switch slider of the vapor control sliding switch is placed in the first position.
Figure 9B:
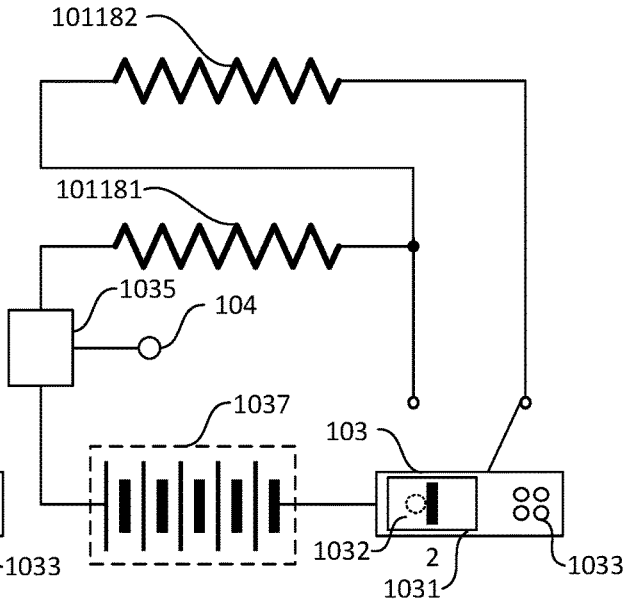
FIG. 9B shows the first heating element and a second heating element are combined in serial for lung smoking when the switch slider of the vapor control sliding switch is placed in the second position.
Figure 9C:
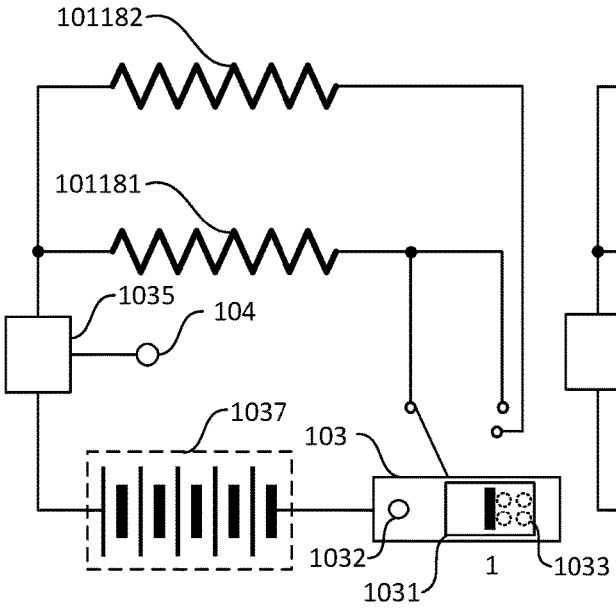
FIG. 9C shows the first heating element is used for mouth smoking when the switch slider of the vapor control sliding switch is placed in the first position.
Figure 9D:
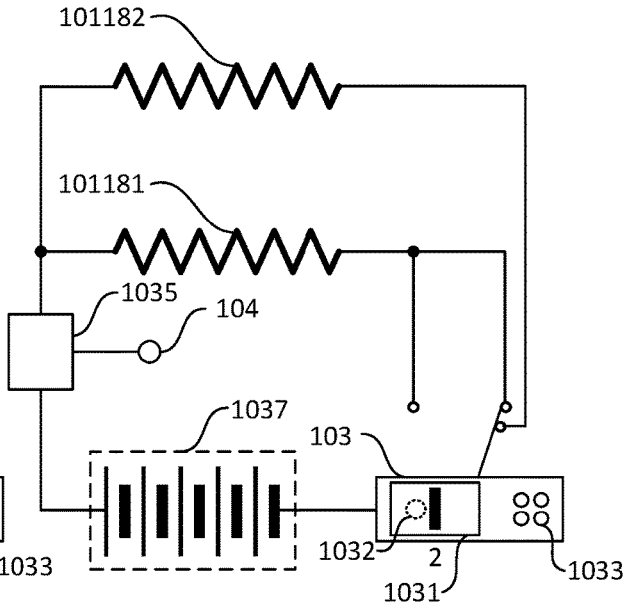
FIG. 9D shows the first heating element and the second heating element are combined in parallel for lung smoking when the switch slider of the vapor control sliding switch is placed in the second position.

In certain embodiments, the first set of heating element includes the first heating element 101181 as shown in FIG. 8A, FIG. 9A and FIG. 9C. In one embodiment, the second set of heating element includes the second heating element 101182 as shown in FIG. 8B. In another embodiment, the second set of heating element includes the first heating element 101181 and the second heating element 101182 connected in serial as shown in FIG. 8B and FIG. 9B. In yet another embodiment, the second set of heating element includes the first heating element 101181 and the second heating element 101182 connected in parallel as shown in FIG. 9D.

In certain embodiments, the E-liquid vapor volume generated by the convertible vaporizer 10118 is selectable by a user and the selectable E-liquid volume includes a small E-liquid vapor volume generated by a first set of heating element for mouth smoking and a large E-liquid vapor volume generated by a second set of heating element for lung smoking.

Figure 4:
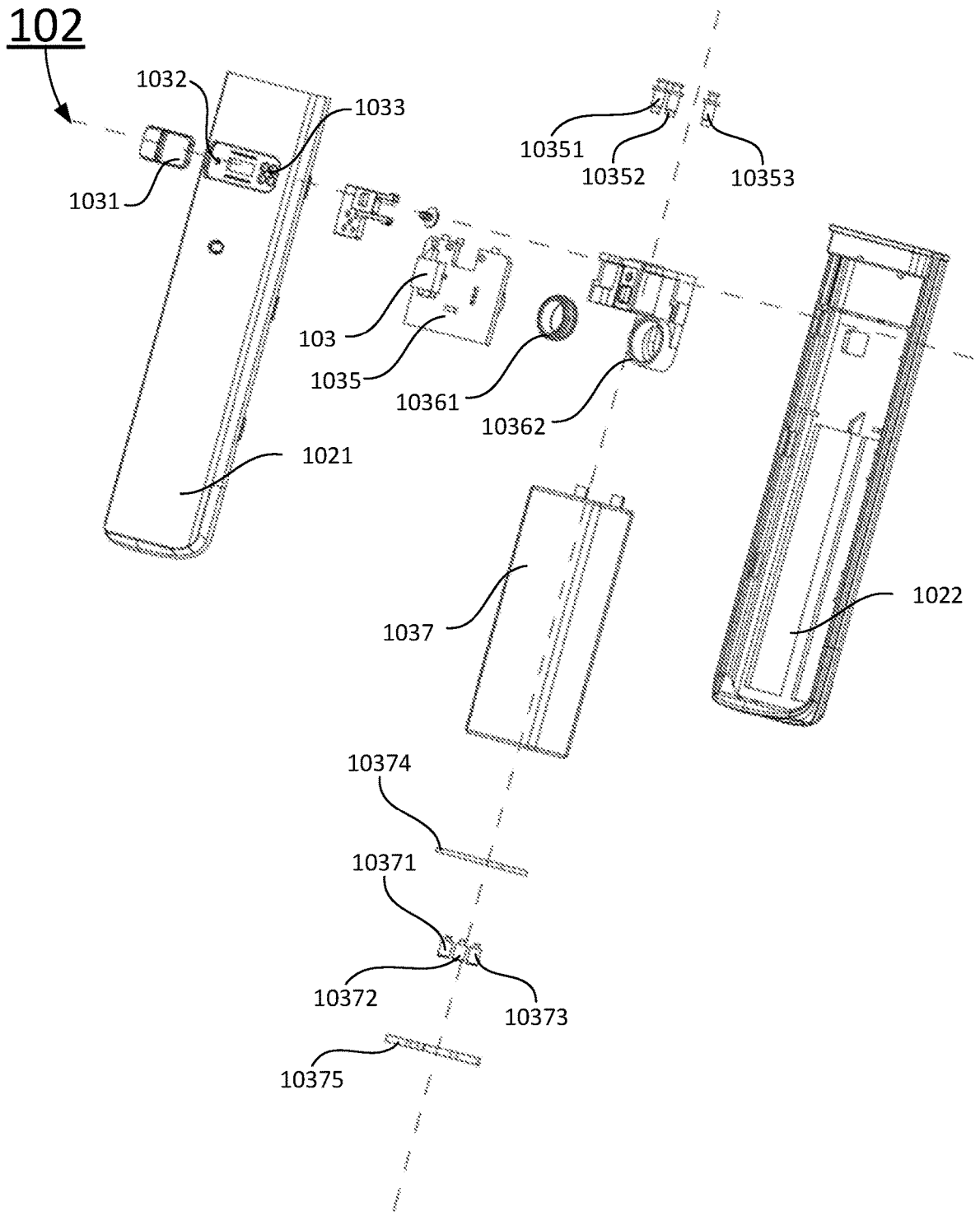
FIG. 4 is an exploded perspective view of a cartridge bottom portion of the exemplary mouth to lung convertible electronic cigarette according to certain embodiments of the present disclosure.
Figure 8C:
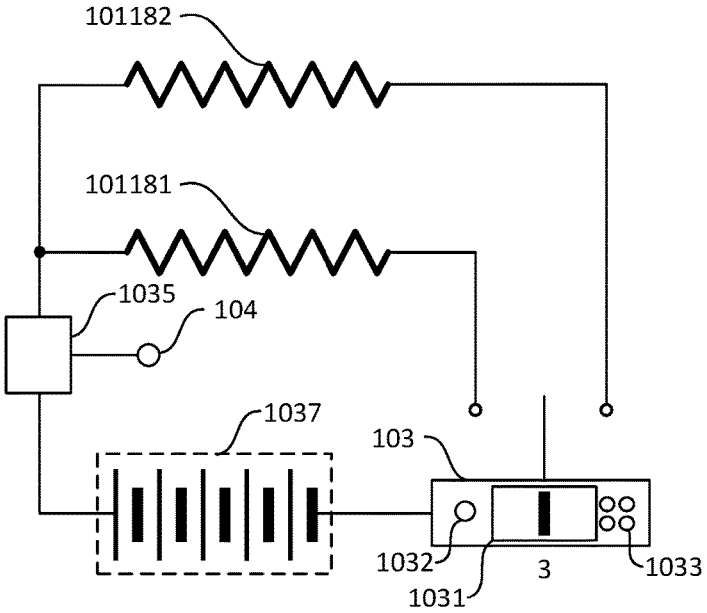
FIG. 8C shows the exemplary control circuit when the switch slider of the vapor control sliding switch is placed in a third, off position.

In certain embodiments, as shown in FIG. 4, the cartridge bottom portion 102 includes a front cover 1021 and a back cover 1022. The vapor control sliding switch 103 is positioned on the front cover 1021 and the electrical power source 1037 is positioned inside the front cover 1021 and the back cover 1022. The vapor control sliding switch 103 includes a switch slider 1031. In one embodiment, the switch slider 1031 includes two positions: a first position for mouth smoking, as shown in FIGS. 8A, 9A and 9C, and a second position for lung smoking, as shown in FIGS. 8B, 9B and 9D. In another embodiment, the switch slider 1031 may also include a third, off position for turning off the electrical power source 1037 from the mouth to lung convertible electronic cigarette 10, as shown in FIG. 8C.

In certain embodiments, the vapor control sliding switch 103 includes a first air intake opening 1032, and a second air intake opening 1033, both positioned under the switch slider 1031. When the switch slider 1031 is placed at the first position, the vapor control sliding switch 103 opens the first air intake opening 1032 and connects the first positive output terminal 10351 of the electrical power source 1037 to the first set of heating element for mouth smoking with small amount of E-liquid vapor. When the switch slider 1031 is placed at the second position, the vapor control sliding switch 103 opens the second air intake opening 1033 and connects the second positive output terminal 10352 of the electrical power source 1037 to the second set of heating element for lung smoking with large amount of E-liquid vapor.

The vapor control sliding switch 103 also includes an air intake 10362 for outside air to flow into the convertible vaporizer 10118 through either the first air intake opening 1032 or the second air intake opening 1033. An air intake sealing ring 10361 may be positioned between the air intake 10362 and the cartridge bottom portion 102 to prevent the air from leaking.

In certain embodiments, the electrical power source 1037 may include a battery and/or a rechargeable battery. The cartridge bottom portion 102 may also include a positive charging terminal 10371, a negative charging terminal 10372, and a ground terminal 10373 for charging the rechargeable electrical power source 1037. The cartridge bottom portion 102 may also include a first insulation plate 10374, and a second insulation plate 10375 for insulating the positive charging terminal 10371, the negative charging terminal 10372, and the ground terminal 10373. In certain embodiments, the rechargeable battery may include including lead-acid, nickel cadmium (NiCd), nickel metal hydride (NiMH), lithium ion (Li-ion), and lithium ion polymer (Li-ion polymer).

In certain embodiments, a control circuit 1035 is positioned inside of the cartridge bottom portion 102 for detecting low E-liquid level condition, displaying a low E-liquid level warning when the E-liquid level in the E-liquid storage tank 10120 is at a first predetermined level and disconnecting the electrical power source 1037 to the mouth to lung convertible electronic cigarette 10 when the E-liquid in the E-liquid storage tank 10120 is at a second predetermined level. The low E-liquid level warning is displayed on the low E-liquid level warning display 104 located on the front cover 1021 of the cartridge bottom portion 102.

Figure 10B:
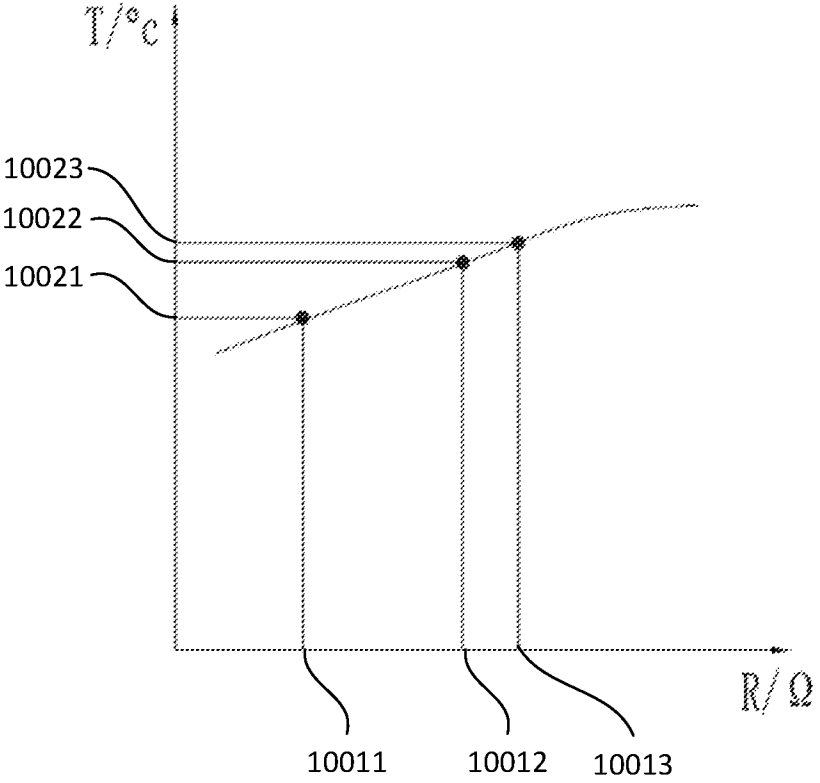
FIG. 10B shows the relationship between the resistance value and temperature value of the convertible vaporizer according to certain embodiments of the present disclosure.
Figure 10A:
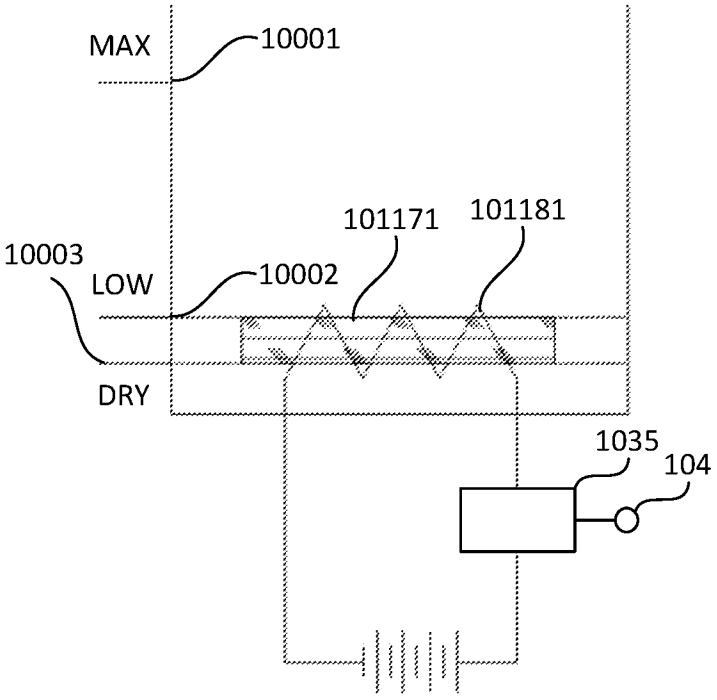
FIG. 10A illustrates how a control circuit of the exemplary mouth to lung convertible electronic cigarette detects E-liquid level in the E-liquid storage tank according to certain embodiments of the present disclosure.

Referring now to FIG. 10A and FIG. 10B, the E-liquid is filled to a MAX point 10001 at the beginning and the temperature of the first heating element 101181 is low at 10021 and the resistance of the first heating element 101181 is low at 10011. As the user smokes, the E-liquid level is lowered and the temperature of the first heating element 101181 goes up and so does the resistance of the first heating element 101181. When the E-liquid level reaches the first predetermined level: LOW point 10002, the temperature of the first heating element 101181 reaches 10022 and the resistance of the first heating element 101181 reaches 10012. When the control circuit 1035 detects that the resistance of the first heating element 101181 reaches 10012, the control circuit 1035 turns on the low E-liquid level warning display 104. The user is advised to fill more E-liquid into the E-liquid storage tank 10120. If the user continues to smoke without filling more E-liquid to the E-liquid storage tank 10120, the temperature of the first heating element 101181 and the resistance of the first heating element 101181 may continue to rise. When the E-liquid level reaches the second predetermined level: DRY point 10003, the temperature of the first heating element 101181 reaches 10023 and the resistance of the first heating element 101181 reaches 10013. When the control circuit 1035 detects that the resistance of the first heating element 101181 reaches 10013, the control circuit 1035 disconnect the electrical power source 1037 from the mouth to lung convertible electronic cigarette 10.

Figure 11:
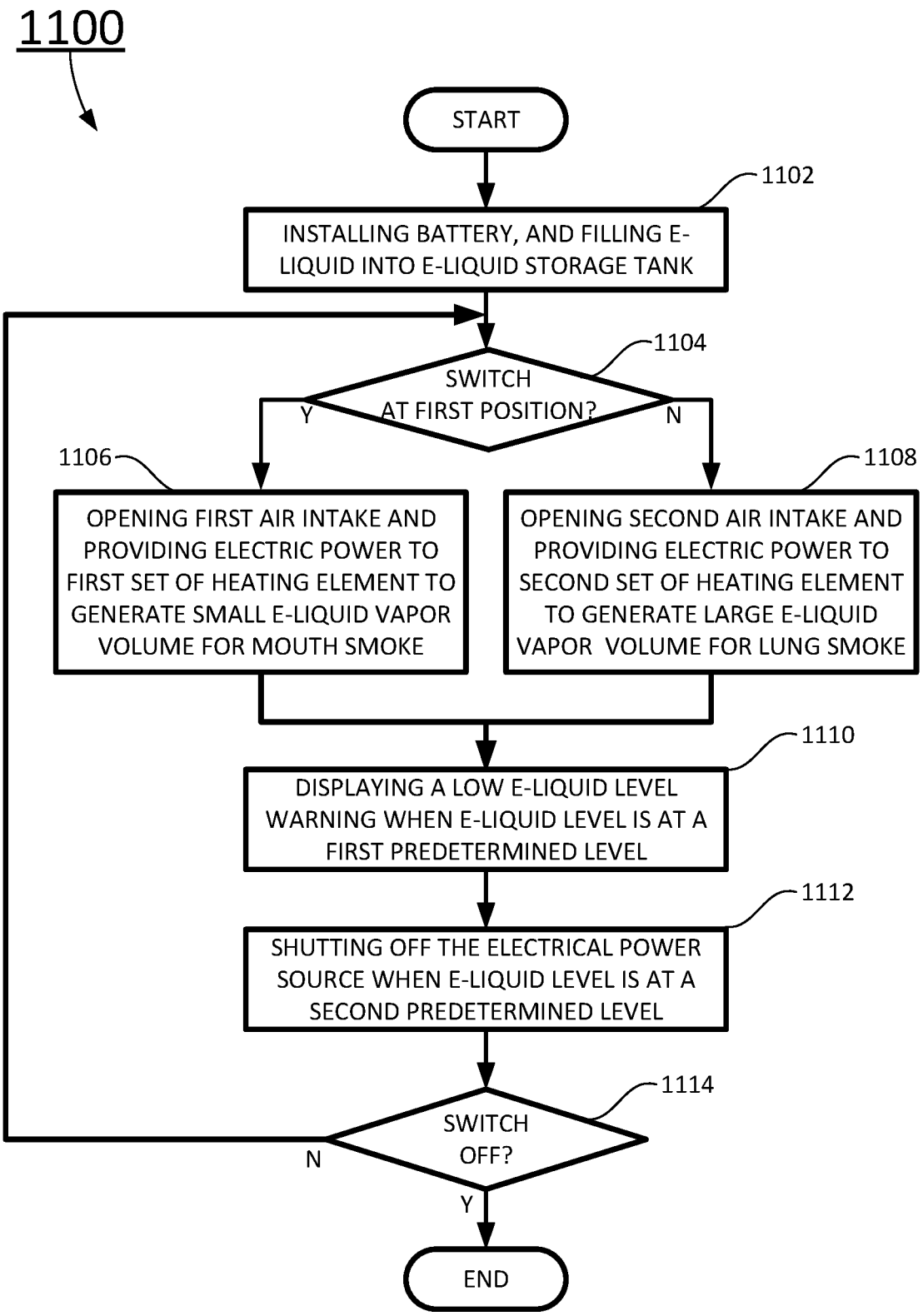
FIG. 11 is a flow chart of an exemplary method of using the exemplary mouth to lung convertible electronic cigarette according to certain embodiments of the present disclosure.

In another aspect, as shown in FIG. 11, the present disclosure relates to a method 1100 of using a mouth to lung convertible electronic cigarette 10.

At block 1102, a user prepares the mouth to lung convertible electronic cigarette 10. The preparation includes: installing an electrical power source 1037 and filling E-liquid into an E-liquid storage tank 10120. In one embodiment, the electrical power source 1037 is a battery. In another embodiment, the electrical power source 1037 is a rechargeable battery. Installing the electrical power source 1037 includes opening a cartridge bottom portion 102 into a front cover 1021 and a back cover 1022, placing the battery or the rechargeable battery between the front cover 1021 and the back cover 1022, and closing the front cover 1021 and the back cover 1022 of the cartridge bottom portion 102. In certain embodiments, installing the electrical power source 1037 may also include charging the rechargeable battery to get the electrical power source 1037 ready.

In certain embodiments, filling E-liquid into the E-liquid storage tank 10120 includes detaching a cartridge top portion 101 from the cartridge bottom portion 102, turning an E-liquid refill cover 10121 around an E-liquid refill cover anchor 101211 in a first direction to expose an E-liquid refill opening 10122, filling E-liquid into the E-liquid storage tank 10120 through the E-liquid refill opening 10122, turning the E-liquid refill cover 10121 around the E-liquid refill cover anchor 101211 in a second, reverse direction to close the E-liquid refill opening 10122, and attaching the cartridge top portion 101 to the cartridge bottom portion 102. The attaching the cartridge top portion 101 to the cartridge bottom portion 102 also includes connecting the electrical power source 1037 in the cartridge bottom portion 102 to a convertible vaporizer 10118 in the cartridge top portion 101.

In certain embodiments, the method also includes: placing, by the user, a switch slider 1031 of a vapor control sliding switch 103 to one of a first position and a second position. The first position corresponds to a mouth smoking position where a small E-liquid vapor volume is generated by a first set of heating element, and the second position corresponds to a lung smoking position where a large E-liquid vapor volume is generated by a second set of heating element.

At branching block 1104, when the switch slider 1031 is placed in the first position, the method continues to block 1106, and when the switch slider 1031 is placed in the second position, the method continues to block 1108.

At block 1106, when the switch slider 1031 is placed in the first position, the switch slider 1031 opens a first air intake opening 1032 and connects the electrical power source 1037 to the first set of heating element to generate the small E-liquid vapor volume by the first set of heating element. In certain embodiments, the first set of heating element includes a first heating element 101181.

At block 1108, when the switch slider 1031 is placed in the second position, the switch slider 1031 opens a second air intake opening 1033 and connects the electrical power source 1037 to the second set of heating element to generate the large E-liquid vapor volume by the second set of heating element.

When the switch slider 1031 is placed in the second position, the method also includes opening a second air intake opening and providing by the electrical power source 1037 electrical power to the second set of heating element to generate the large E-liquid vapor volume by the second set of heating element. In one embodiment, the second set of heating element includes a second heating element 101182. In another embodiment, the second set of heating element includes the first heating element 101181 and the second heating element 101182 connected in serial. In yet another embodiment, the second set of heating element includes the first heating element 101181 and the second heating element 101182 connected in parallel.

At block 1110, in certain embodiments, the method includes: displaying a warning when a control circuit 1035 detects that level of the E-liquid filled in the E-liquid storage tank 10120 is at a first predetermined level 10002.

At block 1112, in certain embodiments, the method includes: disconnecting the electrical power source 1037 to the mouth to lung convertible electronic cigarette 10 when the control circuit 1035 detects that level of the E-liquid filled in the E-liquid storage tank 10120 is at a second predetermined level 10003.

At branching block 1114, in certain embodiments, the vapor control sliding switch 103 may include a third, off position. When the switch slider 1031 of the vapor control sliding switch 103 is placed in the third, off position, the electrical power source 1037 is disconnected from the mouth to lung convertible electronic cigarette 10 and the method ends. Otherwise, method continues to branching block 1104 and the user continues either mouth smoking or lung smoking depending on the position of the switch slider 1031 of the vapor control sliding switch 103.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to activate others skilled in the art to utilize the disclosure and various embodiments and with various modifications as are suited to the particular use contemplated. Alternative embodiments will become apparent to those skilled in the art to which the present disclosure pertains without departing from its spirit and scope. Accordingly, the scope of the present disclosure is defined by the appended claims, the foregoing description and the exemplary embodiments described therein, and accompanying drawings.

What is claimed is:

1. A mouth to lung convertible electronic cigarette, comprising:

a cartridge top portion having an E-liquid storage tank and a convertible vaporizer, wherein E-liquid vapor volume generated by the convertible vaporizer is selectable by a user, and the selectable E-liquid volume comprises a small E-liquid vapor volume generated by a first set of heating element for mouth smoking and a large E-liquid vapor volume generated by a second set of heating element for lung smoking;

a cartridge bottom portion having a vapor control sliding switch for selecting the E-liquid vapor volume and an electrical power source for providing electrical power to the mouth to lung convertible electronic cigarette; and a control circuit positioned inside of the cartridge bottom portion for detecting low E-liquid level condition, displaying a low E-liquid level warning when the E-liquid level in the E-liquid storage tank is at a first predetermined level and disconnecting the electrical power source from the mouth to lung convertible electronic cigarette when the E-liquid in the E-liquid storage tank is at a second predetermined level.

2. The mouth to lung convertible electronic cigarette of claim 1, wherein the cartridge top portion comprises a mouthpiece cover, wherein the mouthpiece cover defines an E-liquid vapor path in a center of the cartridge top portion allowing air to pass from a bottom of the cartridge top portion, through the convertible vaporizer to a top of the cartridge top portion.

3. The mouth to lung convertible electronic cigarette of claim 1, wherein the first set of heating element comprises a first heating element.

4. The mouth to lung convertible electronic cigarette of claim 3, wherein the second set of heating element comprises:

a second heating element;

the first heating element and the second heating element connected in serial; and the first heating element and the second heating element connected in parallel.

5. The mouth to lung convertible electronic cigarette of claim 2, wherein the convertible vaporizer is positioned around the E-liquid vapor path, and comprises:

a heating element base for mounting the first heating element around a first E-liquid storage medium bar and the second heating element around a second E-liquid storage medium bar;

a first E-liquid storage medium ring in direct contact with the heating element base to allow the E-liquid in the first E-liquid storage medium ring to flow to the first E-liquid storage medium bar and the second E-liquid storage medium bar; and a second E-liquid storage medium ring in direct contact with the first E-liquid storage medium ring to allow the E-liquid in the E-liquid storage tank to flow through the first E-liquid storage medium ring and the second E-liquid storage medium ring to the first E-liquid storage medium bar and the second E-liquid storage medium bar.

6. The mouth to lung convertible electronic cigarette of claim 5, wherein the convertible vaporizer is positioned around the E-liquid vapor path, and comprises:

a heating element e-liquid storage medium for mounting a combined heating element around the heating element e-liquid storage medium;

the first E-liquid storage medium ring in direct contact with the heating element e-liquid storage medium to allow the E-liquid in the first E-liquid storage medium ring to flow to the heating element e-liquid storage medium; and the second E-liquid storage medium ring in direct contact with the first E-liquid storage medium ring to allow the E-liquid in the E-liquid storage tank to flow through the first E-liquid storage medium ring to the heating element e-liquid storage medium.

7. The mouth to lung convertible electronic cigarette of claim 6, wherein the combined heating element comprises a first heating element portion for generating the small E-liquid vapor volume and a second heating element portion for generating the large E-liquid vapor volume.

8. The mouth to lung convertible electronic cigarette of claim 7, wherein the first heating element portion comprises the first heating element, and the second heating element portion comprises the second heating element, the first heating element and the second heating element connected in serial, and the first heating element and the second heating element connected in parallel.

9. The mouth to lung convertible electronic cigarette of claim 1, wherein the cartridge top portion comprises a first heating element positive terminal for connecting the first set of heating element to a first positive output terminal of the electrical power source, a second heating element positive terminal for connecting the second set of heating element to a second positive output terminal of the electrical power source, and a heating element negative terminal for connecting a negative output terminal of the electrical power source to the first set of heating element and the second set of heating element.

10. The mouth to lung convertible electronic cigarette of claim 9, wherein the vapor control sliding switch comprises a switch slider, wherein the vapor control sliding switch comprises a first position for mouth smoking and a second position for lung smoking, when the switch slider is placed at the first position, the vapor control sliding switch opens a first air intake opening and connects the first positive output terminal of the electrical power source to the first set of heating element, and when the switch slider is placed at the second position, the vapor control sliding switch opens a second air intake opening and connects the second positive output terminal of the electrical power source to the second set of heating element.

11. The mouth to lung convertible electronic cigarette of claim 10, wherein the vapor control sliding switch further comprises a third position, when the switch slider is placed at the third position, the electrical power source is disconnected from the first set of heating element and the second set of heating element.

12. The mouth to lung convertible electronic cigarette of claim 1, wherein the E-liquid storage tank comprises an E-liquid refill cover 10121 attached on the E-liquid storage tank through an E-liquid refill cover anchor 101211, wherein the E-liquid refill cover 10121 may be rotated in a first direction to expose an E-liquid refill opening 10122 for refilling E-liquid into the E-liquid storage tank, and rotated in a second, reverse direction to close the E-liquid refill opening 10122 after the refilling.

13. A method of using a mouth to lung convertible electronic cigarette, comprising:

filling, by a user, E-liquid into an E-liquid storage tank;

installing, by the user, an electrical power source into a cartridge bottom portion;

placing, by the user, a switch slider of a vapor control sliding switch to one of a first position and a second position, wherein the first position corresponds to a mouth smoking position where a small E-liquid vapor volume is generated by a first set of heating element, and the second position corresponds to a lung smoking position where a large E-liquid vapor volume is generated by a second set of heating element;

opening, a first air intake opening, and providing, by the electrical power source, electrical power to the first set of heating element to generate the small E-liquid vapor volume by the first set of heating element, when the switch slider is placed in the first position, and opening, a second air intake opening and providing, by the electrical power source, electrical power to the second set of heating element to generate the large E-liquid vapor volume by the second set of heating element, when the switch slider is placed in the second position.

14. The method of claim 13, wherein the vapor control sliding switch further comprises a third position, wherein when the switch slider of the vapor control sliding switch is placed in the third position, the electrical power source is disconnected from the mouth to lung convertible electronic cigarette.

15. The method of claim 13, wherein the first set of heating element comprises a first heating element.

16. The method of claim 15, wherein the second set of heating element comprises:

a second heating element;

the first heating element and the second heating element connected in serial; and the first heating element and the second heating element connected in parallel.

17. The method of claim 16, wherein the mouth to lung convertible electronic cigarette comprises a convertible vaporizer positioned around an E-liquid vapor path, and the convertible vaporizer comprises:

a heating element base for mounting the first heating element around a first E-liquid storage medium bar and the second heating element around a second E-liquid storage medium bar;

a first E-liquid storage medium ring in direct contact with the heating element base to allow the E-liquid in the first E-liquid storage medium ring to flow to the first E-liquid storage medium bar and the second E-liquid storage medium bar; and a second E-liquid storage medium ring in direct contact with the first E-liquid storage medium ring to allow the E-liquid in the E-liquid storage tank to flow through the first E-liquid storage medium ring and the second E-liquid storage medium ring to the first E-liquid storage medium bar and the second E-liquid storage medium bar.

18. The method of claim 17, wherein the mouth to lung convertible electronic cigarette comprises the convertible vaporizer positioned around the E-liquid vapor path, and the convertible vaporizer comprises:

a heating element e-liquid storage medium for mounting a combined heating element around the heating element e-liquid storage medium;

the first E-liquid storage medium ring in direct contact with the heating element e-liquid storage medium to allow the E-liquid in the first E-liquid storage medium ring to flow to the heating element e-liquid storage medium;

the second E-liquid storage medium ring in direct contact with the first E-liquid storage medium ring to allow the E-liquid in the E-liquid storage tank to flow through the first E-liquid storage medium ring to the heating element e-liquid storage medium;

wherein the combined heating element comprises a first heating element portion having the first heating element for generating the small E-liquid vapor volume; and a second heating element portion for generating the large E-liquid vapor volume, wherein the second heating element portion comprises the second heating element, the first heating element and the second heating element connected in serial, and the first heating element and the second heating element connected in parallel.

19. The method of claim 13, further comprising: displaying a warning when a control circuit detects that level of the E-liquid filled in the E-liquid storage tank is at a first predetermined level.

20. The method of claim 19, further comprising: disconnecting the electrical power source from the mouth to lung convertible electronic cigarette when the control circuit detects that level of the E-liquid filled in the E-liquid storage tank is at a second predetermined level.

* * * * *